US005950332A

United States Patent [19]

Lain

[11] Patent Number: 5,950,332

[45] Date of Patent: Sep. 14, 1999

[54] FLUID CIRCULATING CUSHIONED INSOLE

[76] Inventor: Cheng Kung Lain, 2092 14th Ave., San Francisco, Calif. 94116

[21] Appl. No.: 08/915,219

[22] Filed: Aug. 28, 1997

[51] Int. Cl.[6] ..... A43B 13/18; A43B 13/20; A43B 13/38; A43B 21/26

[52] U.S. Cl. ..... 36/3 B; 36/28; 36/29; 36/35 B; 36/147

[58] Field of Search ..... 36/28, 29, 35 B, 36/43, 141, 147, 153, 8.1, 3 B

[56] References Cited

U.S. PATENT DOCUMENTS

| | | | |
|---|---|---|---|
| 466,061 | 12/1891 | Locke | 36/3 B |
| 568,068 | 9/1896 | Hilgert | 36/3 B |
| 1,193,608 | 8/1916 | Poulson | 36/29 |
| 2,177,116 | 10/1939 | Persichino | 36/29 |
| 4,446,634 | 5/1984 | Johnson et al. | 36/29 |
| 5,010,661 | 4/1991 | Chu | 36/3 B |
| 5,416,986 | 5/1995 | Cole et al. | 36/29 |
| 5,524,364 | 6/1996 | Cole et al. | 36/29 |
| 5,673,498 | 10/1997 | Amir et al. | 36/29 |
| 5,675,914 | 10/1997 | Cintron | 36/3 B |
| 5,678,328 | 10/1997 | Schmidt et al. | 36/29 |
| 5,701,687 | 12/1997 | Schmidt et al. | 36/29 |

FOREIGN PATENT DOCUMENTS

| | | | |
|---|---|---|---|
| 200963 | 12/1958 | Austria | 36/153 |
| 2800359 | 7/1979 | Germany | 36/28 |
| 3701826 | 10/1987 | Germany | 36/29 |
| 2165439 | 4/1986 | United Kingdom | 36/3 B |
| 91/16831 | 11/1991 | WIPO | 36/29 |
| 93/12685 | 7/1993 | WIPO | 36/29 |

*Primary Examiner*—Paul T. Sewell
*Assistant Examiner*—Anthony Stashick
*Attorney, Agent, or Firm*—Zarley, McKee, Thomte Voorhees & Sease Dennis L. Thomte

[57] ABSTRACT

A fluid circulating cushioned insole for a shoe includes a base panel and a top panel. A series of three cavities are molded into the panels including a heel c, an arch cavity and a metatarsal c. Three channels connect the cavities for circulating flow from the heel cavity to the arch cavity to the metatarsal cavity and back to the heel c. Each channel is equipped with a one-way flow valve constraining the fluid within the cavities and channels to uni-directional circulating flow to massage the foot during each step. The foot is also ventilated during each step by providing an open-bottomed pump cavity in the bottom surface of the base panel, which cavity is connected by at least one open-bottomed channel extending forwardly into fluid communication with a series of vent holes through the base panel. A matrix of branched channels connect each of the vent holes to the longitudinal channels. The pump cavity and various channels are closed and sealed as the shoe engages a floor surface to force air forwardly and upwardly through the vent holes to ventilate, cool and dry the wearers foot.

12 Claims, 3 Drawing Sheets

FLUID CIRCULATING CUSHIONED INSOLE

BACKGROUND OF THE INVENTION

1. Field of the Invention

The present invention is directed generally to an insole for a shoe, more particularly to an insole having a heel cavity, an arch cavity and a metatarsal cavity and interconnecting channels formed in at least one of the base and top panels which are sealed together around the periphery of the cavities and channels to form a sealed flow path. Fluid is contained within the cavities and channels and a one-way flow valve operatively associated with each interconnecting channels constrains the fluid to flow in a direction from the heel cavity to the arch cavity to the metatarsal cavity to the heel c. The bottom surface of the base panel may have an open-bottomed pump cavity adjacent the heel end, an open-bottomed channel extended forwardly from the pump cavity and a plurality of vent holes through the insole and in fluid communication with the open-bottomed channel such that, upon compression of the heel cavity when a wearer steps onto his or her heel, air is pumped forwardly through the open-bottomed channel and vent-holes to ventilate a wearers foot.

2. Brief Description of the Prior Art

Cushioned insoles for shoes have long been know both as permanent shoe insoles and as insole inserts for added comfort for a wearers feet. The effect of such inserts, however is limited to cushioning in a single vertical direction. Fluid filled chambers interconnected by valved channels have previously been provided in footwear such as disclosed in Cole et. al. U.S. Pat. No. 5,416,986 but that invention required unacceptable appearance altering changes to the heel and sole portion of the shoe. Neither of these types of shoe improvements afforded any positive ventilation of the foot within a shoe.

Accordingly, an object of the present invention is to provide an improved insole for a shoe which affords a three dimensional massaging action for the foot of a wearer.

Another object is to provide an improved insole which affords both the three-dimensional massaging action for the foot of a wearer and positive ventilation for the wearers foot.

Another object is to provide an improved insole which is maintenance free.

Another object is to provide an improved insole which is simple and rugged instruction, economical to manufacture and efficient in operation.

SUMMARY OF THE INVENTION

The fluid circulating cushioned insole of the invention includes a base panel, a top panel overlying the base panel and three cavities formed in at least one of the panels and adapted to be closed and sealed by the other panel. The cavities include a heel cavity adjacent the heel end of the base panel, and arch cavity in the arch area and a metatarsal cavity situated forwardly of the arch cavity. These cavities are interconnected by three channels formed in at least one of the base and top panels. The top and bottom panels are sealed together around the periphery of the cavities and channels so that the cavities and channels collectively form a sealed flow path. A fluid is situated in the cavities and channels and a one-way valve is operatively associated with each channel so that fluid is constrained to flow in the direction from the heel cavity to the arch cavity to the metatarsal cavity and back to the heel cavity.

The cavities and channels are preferably formed in both the top surface of the base panel and bottom surface of the top panel. The one-way flow valve associated with each channel is preferably a flapper valve in the form of a simple L-shaped member having a base leg heat sealed to the channel wall and a flapper leg positioned to bear against a peripheral shoulder of a channel restriction defining a reduced opening.

Ventilation of the foot is provided by an open-bottomed pump cavity in the bottom surface of the base panel adjacent the heel end. At least one open-bottomed channel in communication with the pump cavity extends forwardly toward the toe end of the insole and a plurality of vent-holes through the insole forwardly of the arch area are arranged in communication with the channel so that, upon compression of the pump cavity against a surface when a wearer puts weight on his heel, air is pumped forwardly through the channel and vent holes to ventilate a wearers foot. A pair of channels may extend forwardly from the pump cavity and the vent holes may be arranged in a matrix interconnected by a plurality of generally transverse branch channels intersecting the longitudinally extended channels.

DESCRIPTION OF THE PREFERRED EMBODIMENTS

Figure 1:
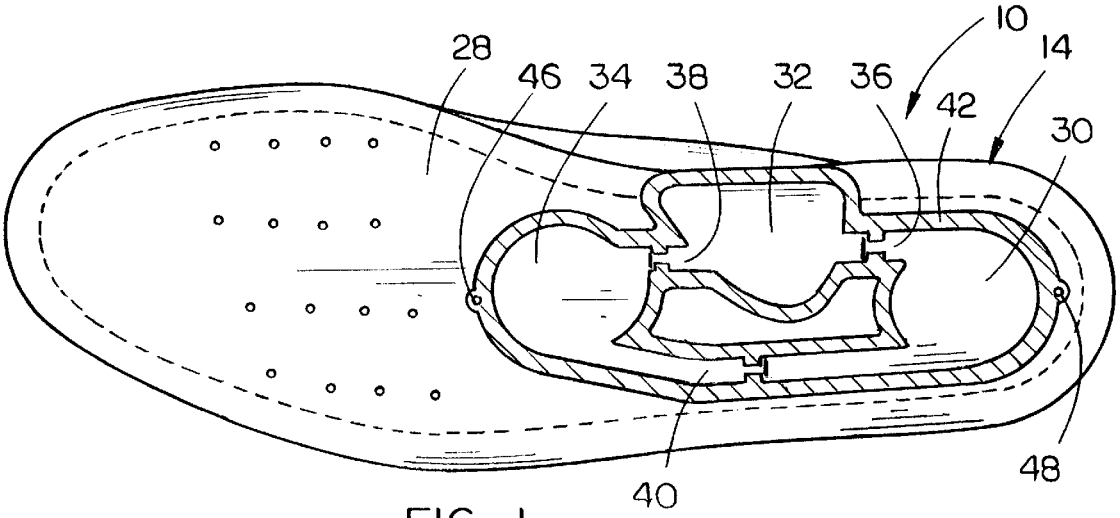
FIG. 1 is a bottom plan view of the bottom surface of the top panel of the fluid circulating cushioned insole of the invention.
Figure 2:
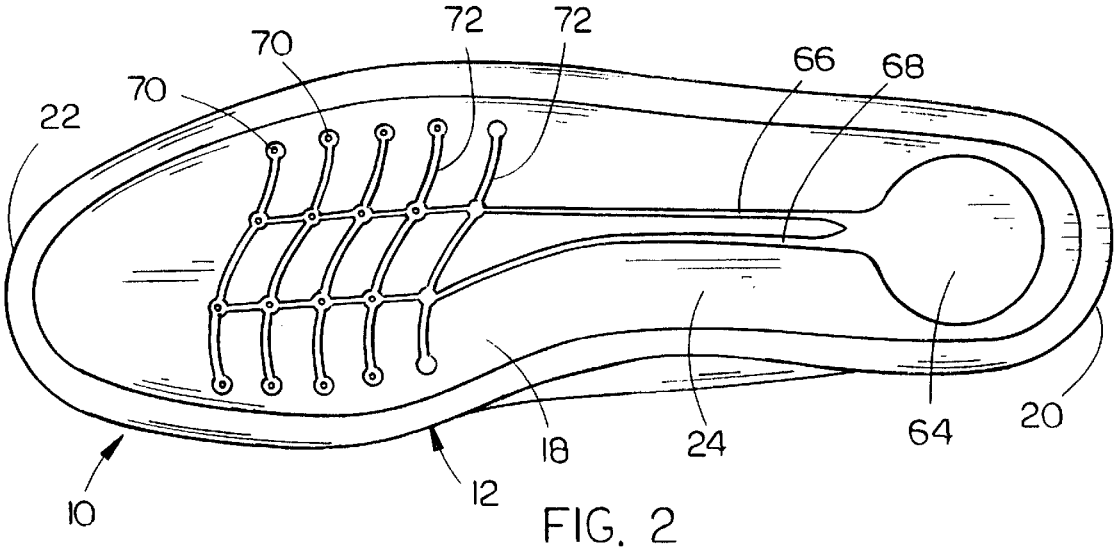
FIG. 2 is a bottom plan view of the bottom surface of the base panel of the fluid circulating cushioned insole of the invention.
Figure 3:
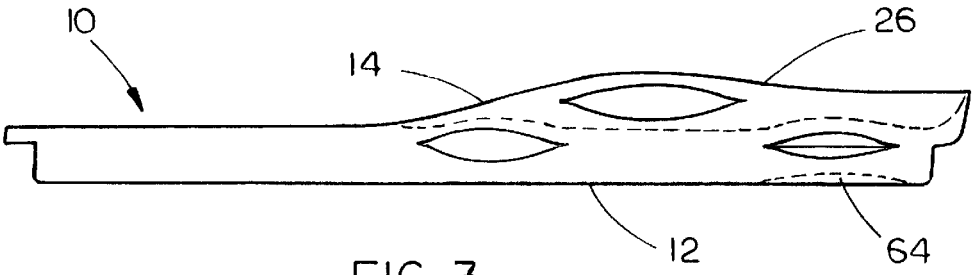
FIG. 3 is a side sectional view of the insole of the invention showing the relative vertical position of the fluid cavities therein.

The fluid circulating cushioned insole 10 of the present invention is shown in FIGS. 1, 2 and 3 and a laminated structure including the base panel 12 and a top panel 14. Base panel 12 has a top surface 16, a bottom surface 18, a heel end 20, an opposite toe end 22 situated forwardly of the heel end 20, and an arch area 24. Top panel 14 likewise has a top surface 26 and a bottom surface 28. Both panels 12 and 14 are preferably formed of a resilient polyurethane material.

The top surface 16 of base panel 12 and the bottom surface 28 of top panel 14 each include three cavities positioned for registration with the cavities of the opposite panel. Referring to FIG. 1, the bottom surface 28 of top panel 14 has formed therein a heel cavity 30 adjacent the heel end of the insole, an arch cavity 32 in the arch area and a metatarsal cavity 34 situated forwardly of the arch cavity.

Likewise, the top surface 16 of base panel 12 and bottom surface 28 of top panel 14 are molded to partially define three channels interconnecting the cavities, namely a heel to arch channel 36 having ends in communication with the heel and arch cavities 30 and 32, and arch to metatarsal channel 38 having ends in communication with the arch cavity 32 and metatarsal cavity 34, and a metatarsal to heel channel having ends in communication with the metatarsal and heel cavities 34 and 36.

An outer peripheral edge strip surrounds the three cavities and channels and an inner peripheral edge strip likewise surrounds the interior edges of the cavities and channels to present sealing surfaces for engaging and sealing to the matching and registered outer and inner peripheral edge strips on the top surface 16 of face panel 12. For this purpose, the outer peripheral edge strip 42 of each panel includes a front registration hole 46 and rear registration hole 48 so that the panels are necessarily properly aligned and registered upon registration of the front and rear registration holes of the respective panels.

A fluid such as liquid silicone is contained and sealed within the cavities and channels but in a quantity to enable flow of the fluid between the cavities in response to walking movement of a wearers foot. Whereas liquid silicone is preferred, that fluid could alternatively could also be water, oil or a gas in other embodiments.

Figure 11:
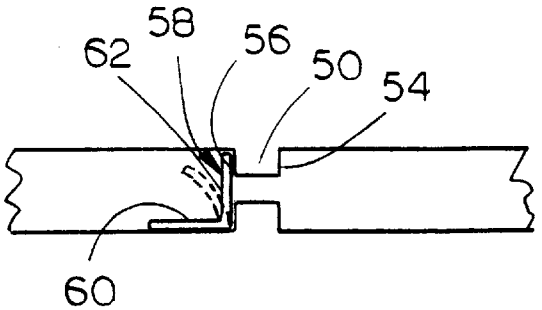
FIG. 11 is a diagrammatic side-sectional view of a one way valve in the connecting channel of the insole.
Figure 10:
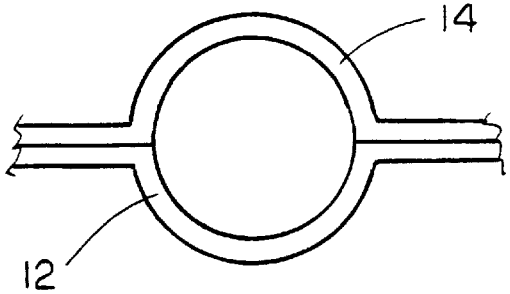
FIG. 10 is a sectional view through a connecting channel of the insole.

Flow of fluid between cavities is controlled by one way flow valves operatively associated with each channel. Referring to FIGS. 1 and 11, the one-way flow valve in the heel to arch channel 36 is described, at being understood that the same structure applies to the valves of the other two channels. First, channel 36 itself is formed with a peripheral channel restriction 50 defining a reduced opening 52 having an upstream end 54 and a downstream end 56. A flapper valve 58 is installed at the downstream end 56 of the reduced opening 52. The flapper valve 58 may simply be somewhat L-shaped strip of polyurethane including a base leg 60 heat sealed to the wall of channel 36 and a free flapper leg 62 overlying the channel restriction 50 so as to engage the peripheral shoulder formed thereby at the downstream end of the reduced opening 52. Upon flow of fluid from the heel cavity 30 to the arch cavity 32, the flapper leg simply is pushed downstream from the solid line position to the dotted line position in FIG. 11. On the other hand, during flow of fluid from the arch cavity 32 to the metatarsal cavity 34, the flapper valve 58 prevents fluid in the arch cavity 32 from traveling back through the heel to arch channel 36 because that fluid pressure engages and seals the flapper leg 62 against the downstream shoulder of the channel restriction 50 to close and seal the reduced opening 52. The same structure is applicable to the flapper valves contained in the arch to metatarsal channel 38 and in the metatarsal to heel channel.

Figure 4:
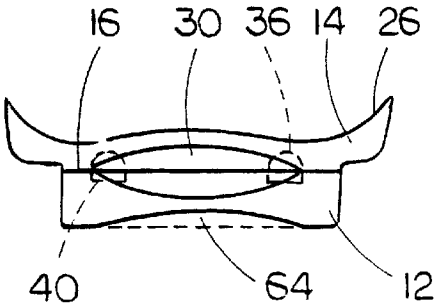
FIG. 4 is a rear sectional view through the heel cavity of the insole.
Figure 5:
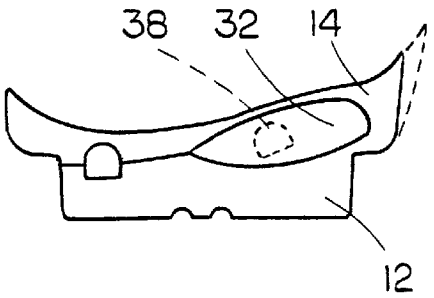
FIG. 5 is a rear sectional view through the arch cavity of the insole.
Figure 6:
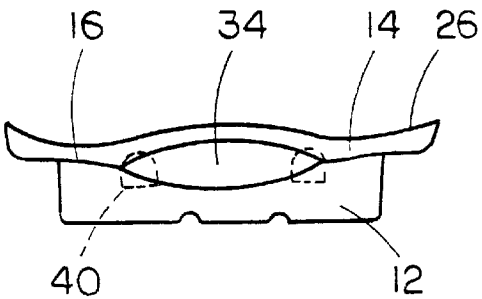
FIG. 6 is a rear sectional view through the metatarsal cavity of the insole.

An important feature of preferred embodiment is the partial molding of each of the cavities and channels in both the base panel 12 and top panel 14. This construction accounts for economical manufacture of the insole and convenient installation of the flapper valves 58. FIGS. 4, 5 and 6 show the line of division between the base panel 12 and top panel 14 for one embodiment of the invention. The forward extent of the top panel may be all the way to the top end of the insole or it may terminate just forwardly of the front registration hole 46 or it would be tapered to blend in with the contour of the bottom panel so as not to be felt by a wearer.

In operation, as one steps forwardly and places weight on the heel of a shoe equipped with the fluid circulating cushioned insole 10 of the invention, the fluid in heel cavity 30 is pressurized and thereby forced through the reduced opening 52 in the flapper valve within the heel to arch channel 36. The flapper valve in the metatarsal to heel channel is forced closed by the pressurized fluid within the heel cavity 30 so no backflow is permitted from the heel cavity 30 directly to the metatarsal cavity 34. Rather, that fluid is directed into the arch cavity 32 to provide comfortable cushioned support as the weight of the wearer moves forwardly from the heel to the arch to the metatarsal portion of the wearers foot during a normal walking step. As the wearers foot bears down on the arch cavity 32 the fluid is advanced through the flapper valve in the arch to metatarsal channel 38 so that the metatarsal cavity provides cushioned support as the weight of the wearer is transferred forwardly. That same cushioning causes a transfer of fluid from the metatarsal cavity 34 through the flapper valve of the metatarsal to heel channel 40 and into the heel channel so that the fluid is there and ready to cushion the heel of the wearer during the next walking step. The insole thus provides a constant, firm yet gentle dynamic motion of fluid, massaging the wearers feet with each step he or she takes.

The insole 10 of the invention is designed to ventilate as well as cushion and massage the wearers foot. Referring to Figure 2, the bottom surface 18 of base panel 12 is molded to provide an open-bottomed pump cavity 64 adjacent the heel end 20 and a pair of open-bottomed channels 66 and 68 in communication with the pump cavity 64 and extended forwardly therefrom. A plurality of vent holes 70 extend through the base panel 12 at positions forwardly of the arch area 24 as shown in FIG. 1. The vent holes are arranged in a matrix with each vent hole communicating with a generally transverse open-bottomed branch channel 72 which intersects and communicates with one of the longitudinal channels 66 and 68. Accordingly, during a normal walking step, the initial weight of the wearer on the heel end of the shoe compresses the pump cavity 64 causing air flow forwardly through the open bottomed channels which are closed by engagement with the floor surface to force that air up through the vent hole 70 for ventilating the wearers forefoot. Such ventilation helps to cool and dry tired and confined feet.

Figure 7:
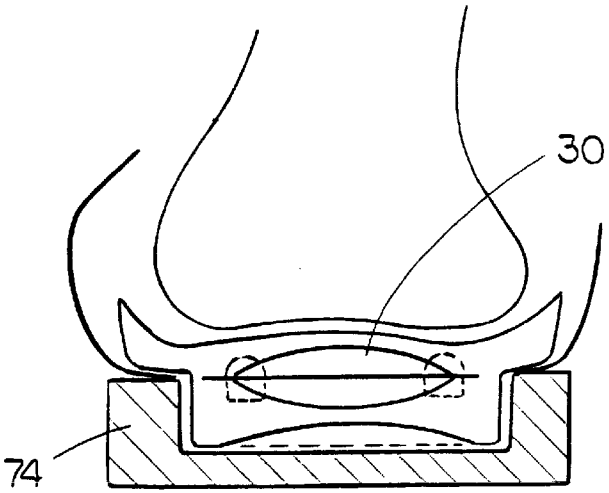
FIG. 7 is a rear sectional view through the heel cavity of the insole showing the insole set within the outsold of a shoe.
Figure 8:
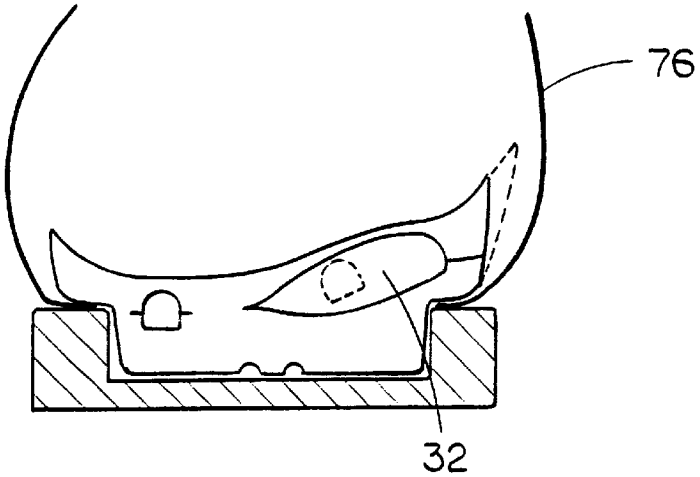
FIG. 8 is a rear sectional view through the arch cavity of the insole showing the insole set within the outsold of a shoe.
Figure 9:
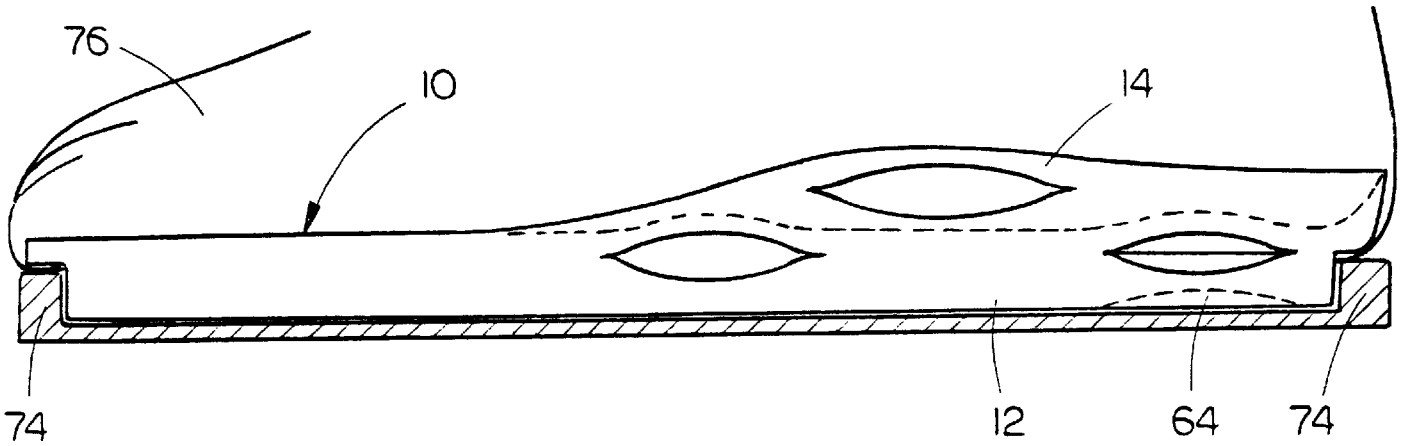
FIG. 9 is a side sectional view showing the insole of the invention set within the outsold of a shoe.

The insole 10 of the invention may be a permanent insole built into a shoe or it may be an insert for placement into any shoe. In the illustrated embodiment, the insole 10 is provided as the primary permanent insole which fits within the outsold 74 of shoe 76 as shown best in FIGS. 7, 8 and 9.

Whereas the invention has been shown in connection with a preferred embodiment thereof, many modification, additions and substitutions may be made which are within the intended broad scope of the appended claims. For example, whereas it is preferred that the cavities and channels be partially formed and both the base panel 12 and top panel 14, any given cavity of channel may be formed in one or the other of the panels and simply closed and sealed by engagement with the other panel so long as fluid communication is maintained between the various cavities and channels as described above. Thus there has been shown and described a fluid circulating cushioned insole which accomplishes at least all of the stated objects.

I claim:

1. A fluid circulating cushioned insole, comprising a base panel having top and bottom surfaces, a heel end, an opposite toe end situated forwardly of the heel end and an arch area, a top panel having top and bottom surfaces and overlying said base panel, the top surface of the base panel and bottom surface of the top panel each including three cavities positioned for registration with the cavities of the opposite panel, said cavities including a heel cavity adjacent the heel end of the base panel, an arch cavity in the arch area and a metatarsal cavity situated forwardly of the arch cavity, the top surface of the base panel and bottom surface of the top p each including three channels interconnecting said cavities, said channels positioned for registration with the channels of the opposite panel, and said channels including a heel to arch channel having ends in communication with said heel and arch cavities, an arch to metatarsal channel having ends in communication with said arch cavity and said metatarsal cavity and a metatarsal to heel channel having ends in communication with said metatarsal and heel cavities, said top and bottom panels being sealed together around the periphery of said cavities of said channels whereby said cavities and channels form a sealed flow path, a fluid in said cavities and channels, and a one-way flow valve operatively associated with each channel whereby fluid is constrained to flow in the direction from said heel cavity to said arch cavity to said metatarsal cavity to said heel cavity.

2. The fluid circulating cushioned insole of claim 1 wherein said one-way flow valve comprises a channel restriction in said channel defining a reduced opening with upstream and downstream ends and a flapper valve overlying the downstream end of said reduced opening.

3. The fluid circulating cushioned insole of claim 2 wherein said channel restriction defines a peripheral shoulder adjacent said reduced opening on the downstream end thereof.

4. The fluid circulating cushioned insole of claim 3 wherein said flapper valve is a generally L-shaped member including a base leg secured to said channel and a flapper leg overlying said peripheral shoulder.

5. The fluid circulating cushioned insole of claim 4 wherein said base leg is heat sealed to said channel.

6. The fluid circulating cushioned insole of claim 5 wherein said base panel and top panel are formed of polyurethane.

7. The fluid circulating cushioned insole of claim 6 wherein said base panel and top panel are heat sealed together around the periphery of said cavities and channels.

8. The fluid circulating cushioned insole of claim 7 wherein said base panel and top panel are each provided with a pair of spaced apart registration holes whereby, upon alignment of said registration holes, said panels are positioned for sealing said panels together.

9. The fluid circulating cushioned insole of claim 1 wherein said bottom surface of said base panel comprises an open-bottomed pump cavity adjacent the heel end, at least one open-bottomed channel in communication with said pump cavity and extended forwardly therefrom, and a plurality of vent holes through said base panel forwardly of said arch area, said vent holes in communication with said channel whereby upon compression of said pump cavity against a surface, air is pumped forwardly through said channel in vent holes to ventilate a wearer's foot.

10. The fluid circulating cushioned insole of claim 9 wherein a pair of channels extend forwardly from said pump cavity.

11. The fluid circulating cushioned insole of claim 10 wherein said plurality of vent holes are arranged in a longitudinally and transversely spaced apart pattern of holes for ventilating a substantial portion of the insole forwardly of said arch area.

12. The fluid circulating cushioned insole of claim 11 further comprising a plurality of generally transverse open-bottomed branch channels in the bottom surface of said base panel establishing fluid communication between said vent holes and said pair of open-bottomed channels.

* * * * *